US009857056B2

(12) United States Patent
McGowan et al.

(10) Patent No.: US 9,857,056 B2
(45) Date of Patent: Jan. 2, 2018

(54) UNIFORM LIGHTING SYSTEM

(71) Applicant: Triplet Music Products Inc., Ottawa (CA)

(72) Inventors: John G. McGowan, Ottawa (CA); Jean Giroux, Saint-Augustin de Desmaures (CA); Mark William Boycott, Ottawa (CA); Colin Peter Roberts, Ottawa (CA); John Scott Gibson, Chelsea (CA)

(73) Assignee: Triplet Music Products Inc., Ottawa (CA)

( * ) Notice: Subject to any disclaimer, the term of this patent is extended or adjusted under 35 U.S.C. 154(b) by 633 days.

(21) Appl. No.: 13/723,911

(22) Filed: Dec. 21, 2012

(65) Prior Publication Data

US 2013/0235576 A1 Sep. 12, 2013

Related U.S. Application Data

(63) Continuation-in-part of application No. 13/415,197, filed on Mar. 8, 2012, now Pat. No. 8,733,961.

(51) Int. Cl.
*F21V 21/00* (2006.01)
*F21V 7/00* (2006.01)
(Continued)

(52) U.S. Cl.
CPC ..... *F21V 7/00* (2013.01); *A47B 19/10* (2013.01); *B42D 3/123* (2013.01); *B42D 3/18* (2013.01);
(Continued)

(58) Field of Classification Search
CPC ..... F21V 33/0048; F21V 7/0066; F21V 7/00; A47B 19/10; A47B 97/00; A47L 319/10
(Continued)

(56) References Cited

U.S. PATENT DOCUMENTS 3,079,491 A 2/1963 Janssen
3,758,774 A * 9/1973 Hildenbrandt ..... G03G 15/30 355/67
(Continued)

FOREIGN PATENT DOCUMENTS

EP 1371897 12/2003
FR 2424004 11/1979
WO WO95/33624 A1 12/1995

OTHER PUBLICATIONS

"The World is Our Stage." Manhasset Specialty Company: Product Brochure [online], [retrieved on Nov. 13, 2013] Oct. 5, 2011. Retrieved from the Internet: <URL: http://www.manhasset-specialty.com/pdfs/ManhassetCatalog-HighRes.pdf> (8 pages).
(Continued)

*Primary Examiner* — Peggy Neils
*Assistant Examiner* — William N Harris
(74) *Attorney, Agent, or Firm* — Nixon Peabody LLP

(57) ABSTRACT

A light bar for illuminating a surface that is substantially perpendicular to the light bar includes an elongated housing extending along an edge of the surface to be illuminated. The housing has a wall adjacent the surface to be illuminated, and at least portions of that wall are transparent. A series of light emitting diodes (LEDs) are mounted within the housing and spaced along the length of the housing for illuminating the surface, and a connector couples the LEDs to an electrical power source for energizing the LEDs to produce light that illuminates the surface.

9 Claims, 11 Drawing Sheets

(51) Int. Cl.

| | |
|---|---|
| ***A47B 19/10*** | (2006.01) |
| ***F21V 33/00*** | (2006.01) |
| ***F21V 7/09*** | (2006.01) |
| ***F21V 13/04*** | (2006.01) |
| ***F21Y 103/10*** | (2016.01) |
| ***F21Y 115/10*** | (2016.01) |
| ***B42D 3/12*** | (2006.01) |
| ***B42D 3/18*** | (2006.01) |
| ***G10G 7/00*** | (2006.01) |

(52) U.S. Cl.
CPC ..... *F21V 7/005* (2013.01); *F21V 7/0008* (2013.01); *F21V 7/0066* (2013.01); *F21V 7/09* (2013.01); *F21V 13/04* (2013.01); *F21V 33/0048* (2013.01); *G10G 7/00* (2013.01); *A47B 2220/0077* (2013.01); *F21Y 2103/10* (2016.08); *F21Y 2115/10* (2016.08)

(58) Field of Classification Search
USPC ..... 362/240, 247, 98, 234, 217.01, 217.13, 362/219, 220
See application file for complete search history.

(56) References Cited

U.S. PATENT DOCUMENTS

| | | | | |
|---|---|---|---|---|
| 3,885,145 | A | 5/1975 | Wise | |
| 4,153,927 | A | 5/1979 | Owens | |
| 4,290,093 | A | 9/1981 | Thompson et al. | |
| 4,680,681 | A | 7/1987 | Fisherman et al. | |
| 5,381,310 | A | 1/1995 | Brotz | |
| 6,088,941 | A | 7/2000 | Inbar et al. | |
| 6,280,052 | B1 | 8/2001 | White | |
| 6,520,643 | B1 | 2/2003 | Holman et al. | |
| 6,558,014 | B2 | 5/2003 | Just et al. | |
| 6,830,356 | B2 | 12/2004 | Larocque | |
| 6,951,403 | B2 | 10/2005 | Bennett, Jr. | |
| 6,954,260 | B2 | 10/2005 | Arnold et al. | |
| 7,001,060 | B1 * | 2/2006 | Kimura | G02B 6/0053 349/63 |
| 7,261,435 | B2 | 8/2007 | Gould et al. | |
| 7,611,260 | B1 | 11/2009 | Lin et al. | |
| 7,695,180 | B2 | 4/2010 | Schardt et al. | |
| 7,708,429 | B2 * | 5/2010 | Kennedy et al. | 362/253 |
| 7,920,320 | B2 * | 4/2011 | Watson et al. | 359/296 |
| 8,585,230 | B2 * | 11/2013 | Schopper | 362/98 |
| 2003/0103351 | A1 | 6/2003 | Privas et al. | |
| 2008/0204888 | A1 * | 8/2008 | Kan et al. | 359/629 |
| 2011/0116265 | A1 | 5/2011 | Salm | |
| 2012/0176786 | A1 | 7/2012 | Presley et al. | |
| 2014/0003028 | A1 * | 1/2014 | Kim et al. | 362/84 |

OTHER PUBLICATIONS

"Triplet Light Quick Reference Guide." Triplet Music Inc. [online], [retrieved on Nov. 13, 2013] Feb. 21, 2013. Retrieved from the Internet: <URL: https://www.tripletlight.com//sites/default/files/uploads/user-manual/tripletlight_instructions july23.2013.pdf> (4 pages).

International Search Report and Written Opinion mailed Jul. 15, 2013 which issued in corresponding International Patent Application No. PCT/CA2013/000200 (10 pages).

Adi Abileah, Backlight-Unit Basics, Guest Editorial, Information Display, Apr. 2012, vol. 28, No. 4, pp. 6 and 48, USA.

Hsiao-Wen Lee, Bor-Shyh Lin, Improvement of Illumination Uniformity for LED Flat Panel Light by Using Micro-Secondary Lens Array, Optics Express, Nov. 5, 2012, vol. 20, No. 56, USA.

* cited by examiner

UNIFORM LIGHTING SYSTEM

FIELD OF THE INVENTION

The present invention relates to a lighting system, and, more particularly, to a system for lighting a substantially flat page, book, or artwork.

BACKGROUND OF THE INVENTION

Musicians have struggled for centuries with properly lighting their music score on their music stand, on a piano or organ, or held in their hands while singing.

Musicians perform and rehearse in many locations such as auditoriums, churches, private homes, and even outdoors. Lighting conditions are often poor thus making it difficult for the musicians to read the music.

Available music lighting solutions include basic and more expensive clip-on lights, basic piano lamps, expensive overhead racking and room lighting, and modified household lighting fixtures.

Generally, all music lights illuminate the music from above, employing a halogen, incandescent, or LED lamp attached to a fixed or flexible goose neck, which is attached to the music stand by means of a crude spring tensioned clamp or placed directly on the surface of a keyboard instrument.

Standard music stand lights and piano lights present many problems, such as inconsistent lighting of the music score both in brightness and in coverage, excessive over-lighting, glare and light in the eyes of the musician, obstruction of the important musician's view of the audience or the conductor, critical eye contact between musicians themselves, and obstruction of the audience's view of the musician. Used on a piano, the overhead light detracts from the beauty of the piano, organ, or music stand.

Generally, the lights require electrical power and in most orchestra settings, this means the use of several extension cords that can be hazardous and unsightly.

For vocalists there are no sensible lighting solutions and they are generally left to rely on whatever room lighting is available.

There are other applications such as artwork lighting and lighting for book reading that share similar issues.

There is a need for a lighting system that provides substantially uniform lighting of a page or other substantially planar and vertical object such as artwork or book. The lighting system must provide minimal spillage outside the light area and must be non-intrusive to the eyesight. It is also desirable that the lighting system be lightweight with low power consumption, low heat dissipation and is optionally battery operable.

SUMMARY OF THE INVENTION

A light bar for illuminating a surface that is substantially perpendicular to the light bar includes an elongated housing extending along an edge of the surface to be illuminated. The housing has a wall adjacent the surface to be illuminated, and at least portions of that wall are transparent. A series of light emitting diodes (LEDs) are mounted within the housing and spaced along the length of the housing for illuminating the surface, and a connector couples the LEDs to an electrical power source for energizing the LEDs to produce light that illuminates the surface. In many applications, such as sheet music stands, the surface to be illuminated is substantially vertical, the light bar extends along the bottom edge of the surface, and the wall adjacent the surface is the top wall of the housing.

In one implementation, the LEDs are oriented to direct light produced by the LEDs through the transparent portions of the wall of the housing and onto the surface to be illuminated. The LEDs may be arranged in multiple rows extending along the length of the housing, with the LEDs in different rows oriented to direct light onto different regions of the surface, so that the surface is illuminated substantially uniformly over its entire area. The number of LEDs in the rows preferably varies according to the distances between the light bar and the regions illuminated by the respective rows of LEDs in the light bar, i.e., the rows illuminating more distant regions of the surface contain more LEDs than rows illuminating less distant regions of the surface.

Another implementation includes a reflector within the housing of the light bar for reflecting light produced by the LEDs onto the surface to be illuminated. The reflector may include a first mirror oriented to illuminate a distant region of the surface, and a second mirror oriented to illuminate a closer region of the surface.

The light bar may be pivotably connected to the surface to be illuminated so that the wall of the housing adjacent the surface to be illuminated can be used as a ledge to support the bottom edges of sheet music or other documents resting against the surface to be illuminated. The light produced by the LEDs in the light bar then illuminates the front surface of the sheet music resting against that surface. In one implementation of this embodiment, the light bar housing and the surface to be illuminated are adapted to form a portfolio for carrying the sheet music or other documents.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings. Embodiments of the present invention will now be described, by way of example only, with reference to the attached Figures.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

This invention is directed to a lighting system or a light bar that is designed to uniformly light a substantially vertical and planar surface such as sheet music, artwork or book. In one embodiment, one or more light bar is integrated to a portfolio, which can be placed on a free standing music stand, piano music stands or held by hand for reading or for choir singing. The portfolio can be designed to fold into a thin, flat case that can be used to also carry the sheet music, paper or a book.

In another embodiment, the light bar is integrated with a picture or artwork frame, to uniformly light the picture or artwork.

In another embodiment, the light bar is integrated into the ledge of a music stand.

Figure 1:
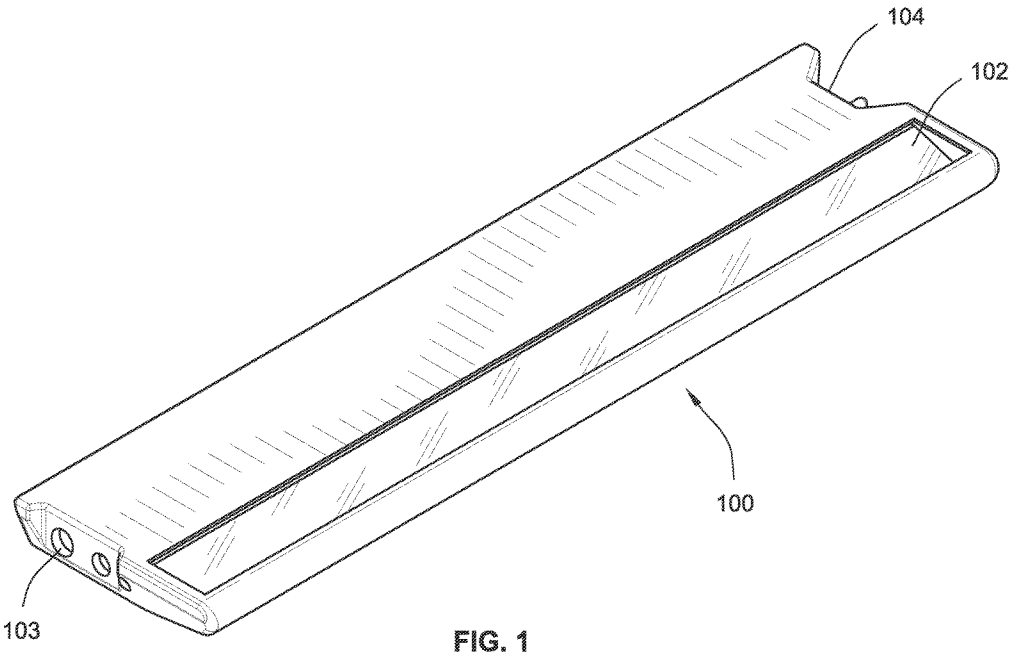
FIG. 1 shows an exemplary embodiment of a light bar.

The light bar generally comprises a housing with room for an electrical power supply or a battery system (dry or rechargeable). The housing includes one or more LEDs and an optical system for distributing the light generated from the LEDs according to a substantially uniform pattern. The optical system comprises one or more devices that transmit, reflect, diffuse or scatter the light. Referring to FIG. 1, an exemplary light bar housing 100 has a substantially thin rectangular shape, with an opening 102 in the housing wall, which includes a light source and an optical system for the distribution of light generated by the light source. Instead of a single opening 102, the housing 100 can have a plurality of transparent portions in the wall. Optionally, controls 103 and a power switch 104 can also be provided.

Figure 2:
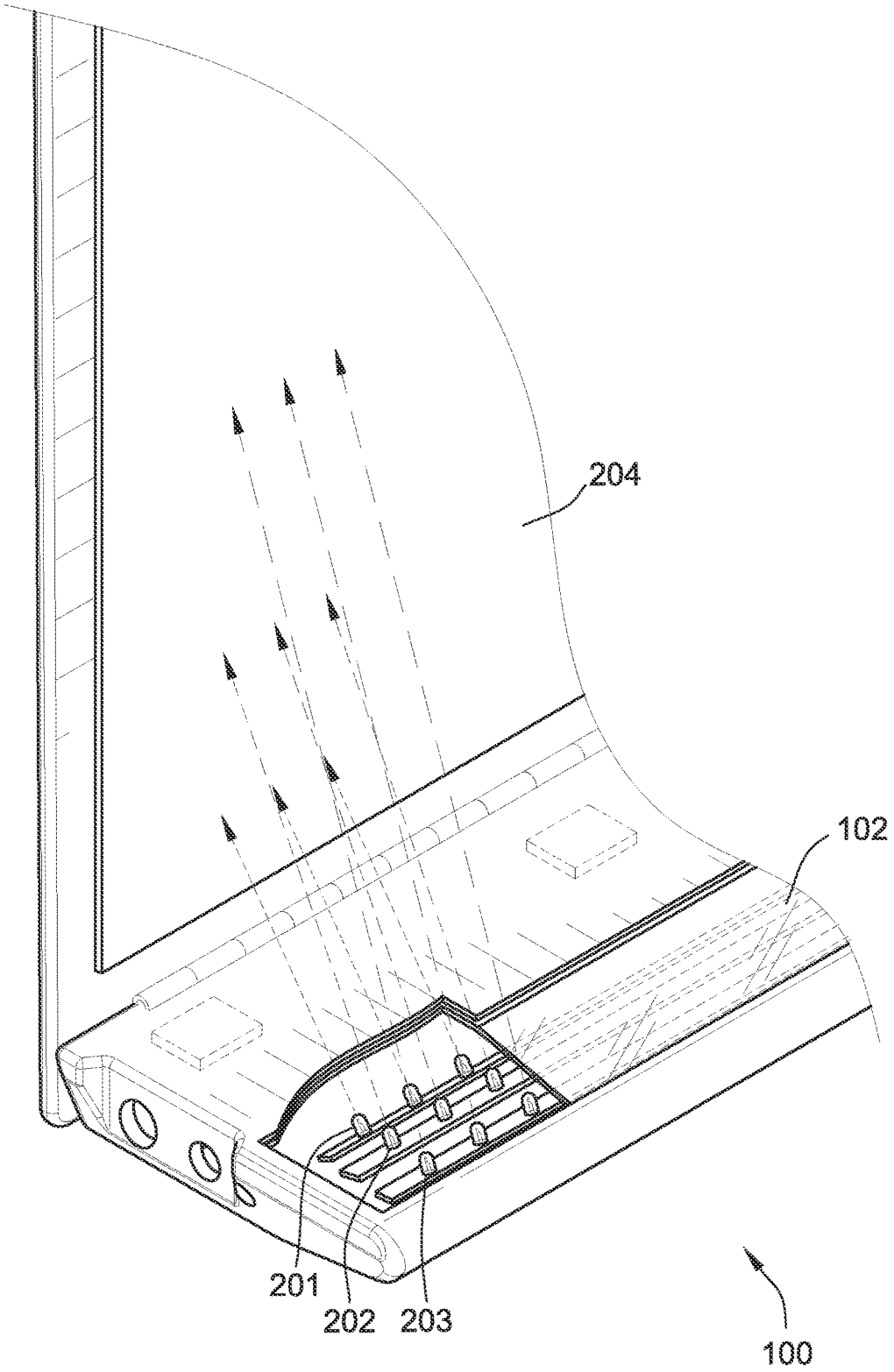
FIG. 2 shows an exemplary direct lighting implementation of a light bar.

Referring to FIG. 2, in one embodiment for the opening 102, the light source includes a plurality of LEDs rows 201, 202, 203 that are mounted within the elongated housing 100, each row providing a predetermined number of LEDs angled to light a specific area of a substantially vertical planar surface 204. In this case, the light is transmitted directly out of the light bar housing 100 through its wall. The number of LEDs per rows and the number of rows is determined as a function of the size of the planar surface. The LEDs in one row can be angled to a specific area of the planar surface. LEDs in one row may optionally be aimed at a different angle. In the example of FIG. 2, a first row 201 includes a first number of LEDs aimed at the bottom of the surface 204, a second row 202 includes a second number of LEDs greater than the first number and angled to light the substantially middle part of the surface 204, and a third row 203 includes a third number of LEDs angled to light the substantially top part of the surface 204. The third number of LEDs is greater than the first and second number of LEDs. By increasing the amount of light going up to the top of the surface, substantially uniform lighting can be achieved over the entire area of the surface.

It would be understood by someone skilled in the art that the embodiment could be implemented with one or more rows, and the number of LEDs per rows can be engineered to achieve different uniformity and lighting strength as required.

Narrow beam LEDs can optionally be used for this embodiment. In this case, lenses can be added to direct the light from one or more LEDs positioned near outer edges of the housing 100 to prevent spillage of light on the edges.

The angle of the LEDs can optionally be controllable on a group or individual row basis to achieve uniformity on a higher or smaller surface while minimizing the spillage. The intensity of the LEDs can optionally be controllable on a group or individual basis.

Figure 3:
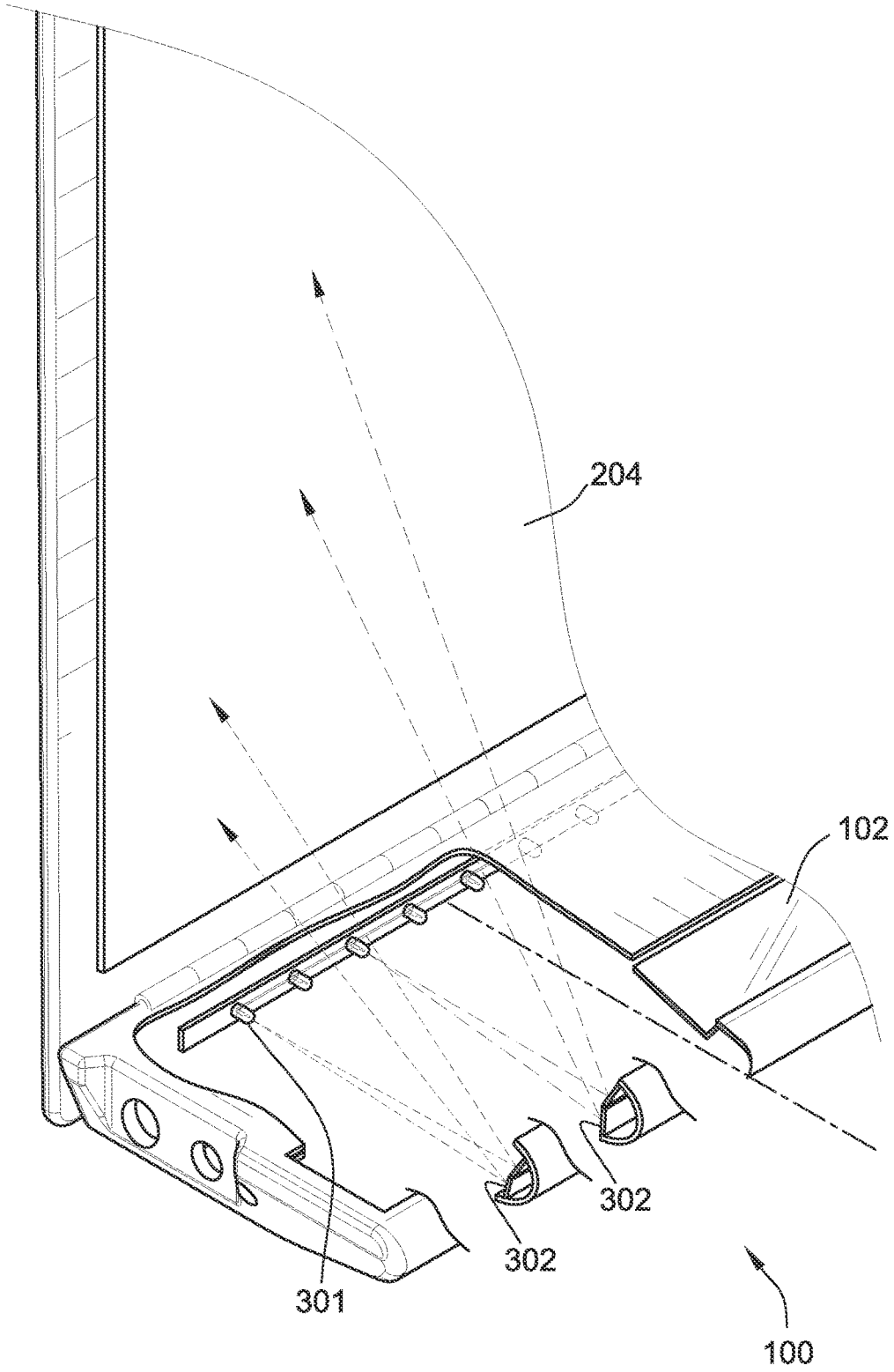
FIG. 3 shows an exemplary indirect lighting implementation of a light bar.
Figure 4:
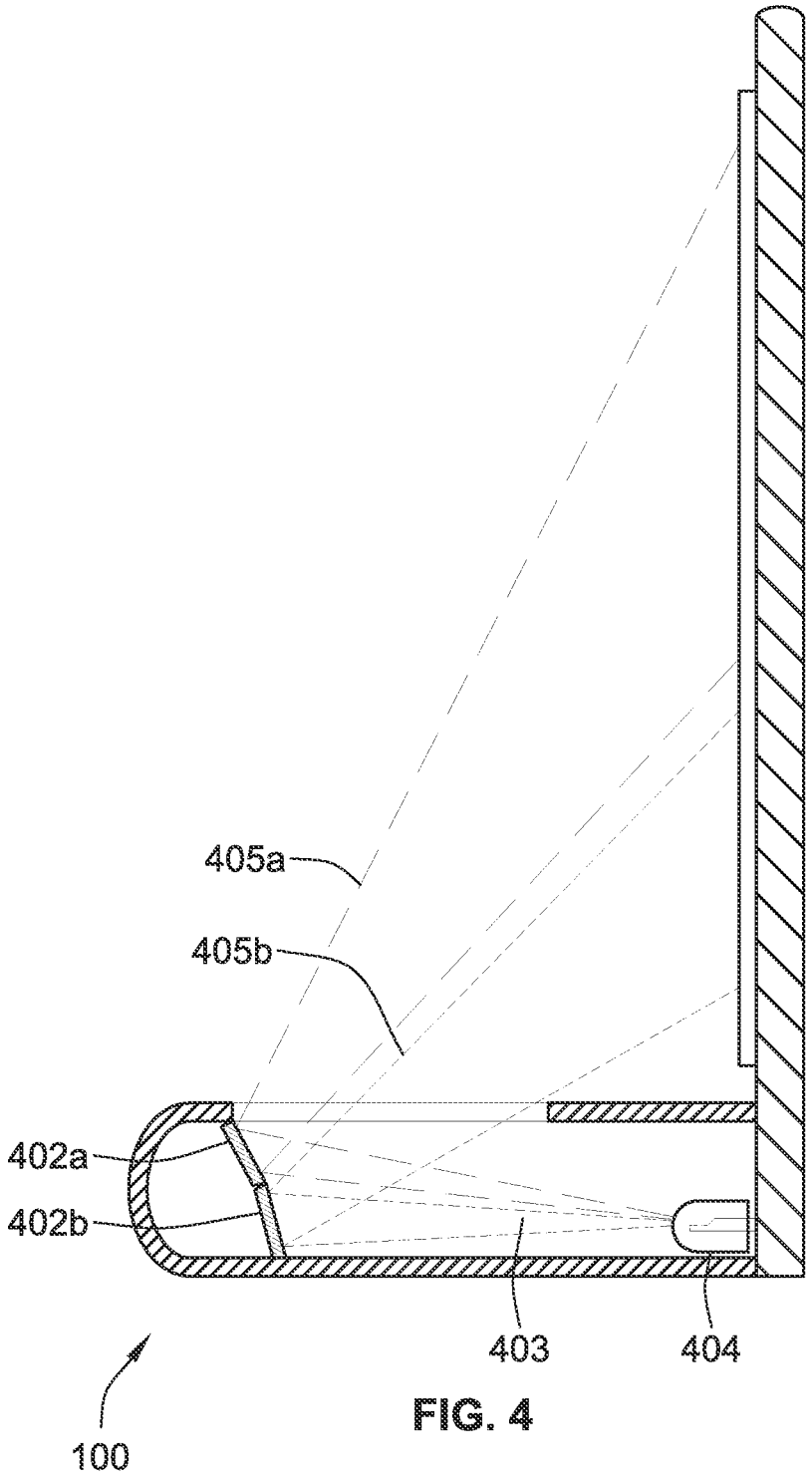
FIG. 4 shows a side cross-sectional representation of a light bar with results achieved by an indirect lighting implementation.
Figure 5:
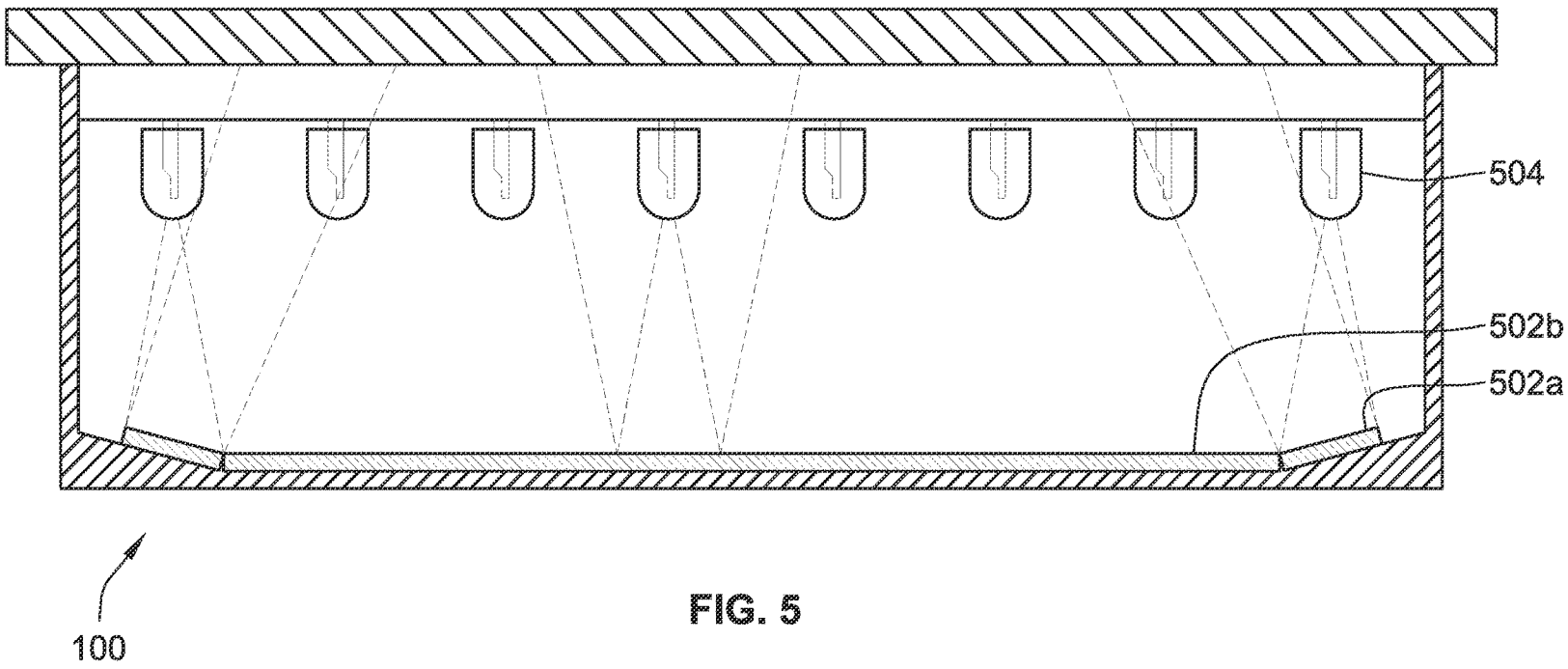
FIG. 5 shows a top cross-sectional representation of a light bar with results achieved by an indirect lighting implementation.

FIG. 3 depicts another embodiment in which a plurality of LEDs 301 is attached substantially vertically in the opening 102, and the optical system includes a reflector 302 (e.g., one or more mirrors) and optionally one or more lenses to redirect the light. In this embodiment, as per FIG. 4, the mirror consists of a split mirror 402*a*, 402*b* that redirects the light 403 from one LED 404 to create two light spots 405*a*, 405*b*. In reference to FIG. 5, several light spots can be created by using one or more angled LEDs 504, which are angled towards a split mirror 502*a*, 502*b*. Optionally, additional light spots can be achieved solely by splitting the mirror into segments 502*a*, 502*b*, or by using a concave mirror. An advantage of this embodiment is that the light source is not directly visible to the eye and therefore cannot interfere, regardless of the angle of the light bar.

With this embodiment, the angle of the projected light can optionally be controllable to achieve uniformity on a higher or smaller surface while minimizing the spillage by controlling the lenses and mirror angle. The intensity of the LEDs can optionally be controllable on a group or individual row basis.

One or more light bars can be integrated together to create a lighting system as described below.

The light bar optionally provides a standby mode in which a very low level of illumination is provided that can be switched directly to the previously set level of intensity with a single button push.

A power switch is provided to turn the light on and off. The intensity of the illumination provided by the light bar can be varied using a dimmer control allowing the user to adjust the intensity of light to their brightness preference, and to immediately compensate for changing lighting conditions. Each row of LED can be moved to aim at a different location independently. If multiple light bars are integrated into a system, then each light bar can be independently controlled or controlled together.

The light bar uses 'white' LEDs as the source of illumination. The LEDs should create minimal heat dissipation and power consumption should be such that the light bar can be operated at full intensity for several hours optionally using either chargeable batteries or a set of disposable dry cell that can be housed in the light bar. The batteries energize the LEDs to produce light and are coupled to the LEDs via a connector.

Figure 6:
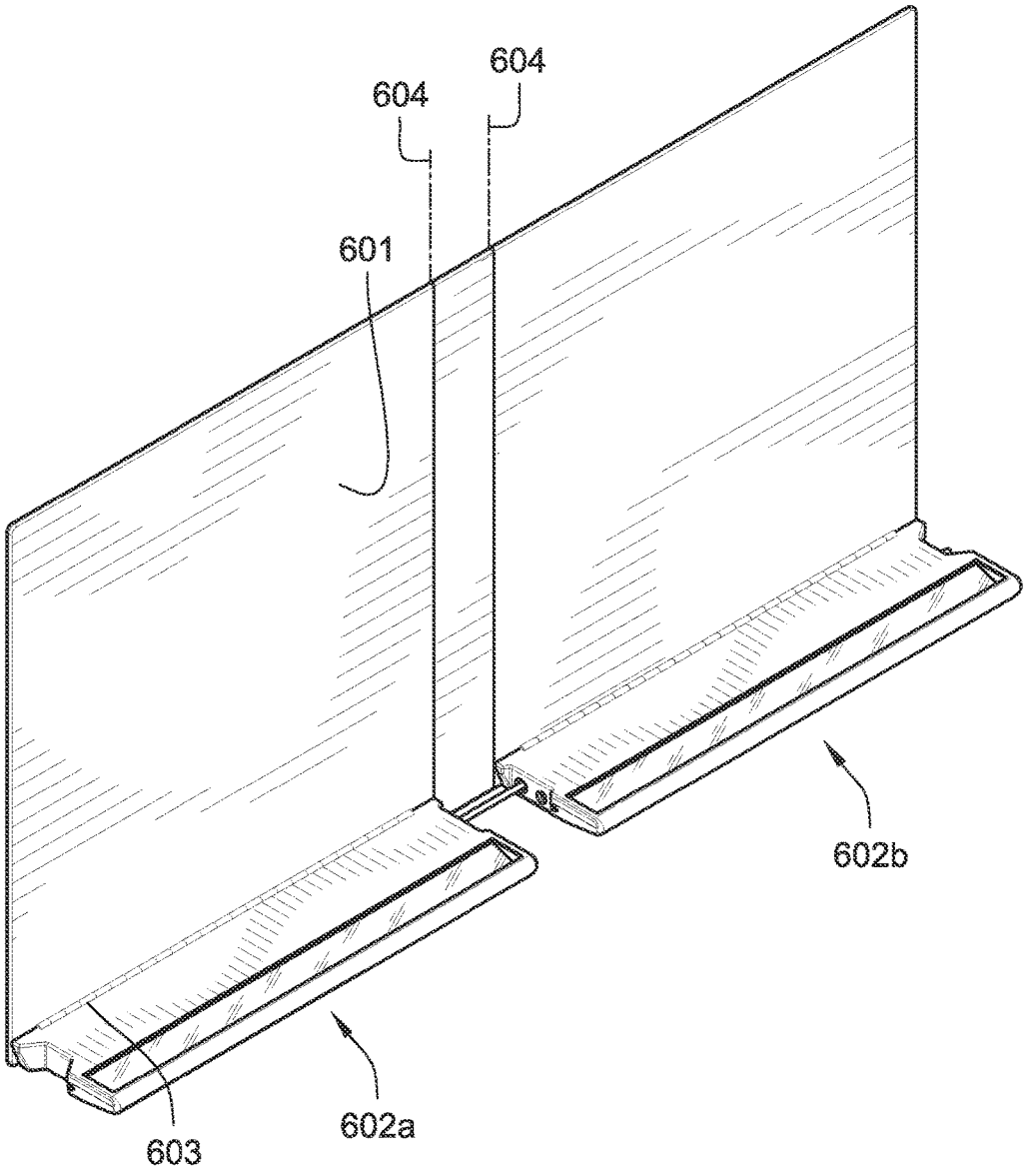
FIG. 6 shows a pair of light bars attached to a music portfolio.

The light bar can be integrated to a portfolio 601 or to a substantially rectangular planar component that can be supported by the music ledge of a music stand, which can support music scores or other documents. Referring to FIG. 6, an exemplary portfolio has two light bars 602*a*, 602*b* coupled to each side of the portfolio via a pair of hinges 603 for folding the light bars 602*a*, 602*b* into the portfolio (e.g., upwards or inwards). Folding the light bars 602*a*, 602*b* upwards facilitates storage and transportation, while folding the light bars 602*a*, 602*b* outwards (or downwards) facilitates illumination of both facing pages of a music score.

When folded outwards, the light bars 602*a*, 602*b* also provide a ledge that can support the music score.

Figure 7:
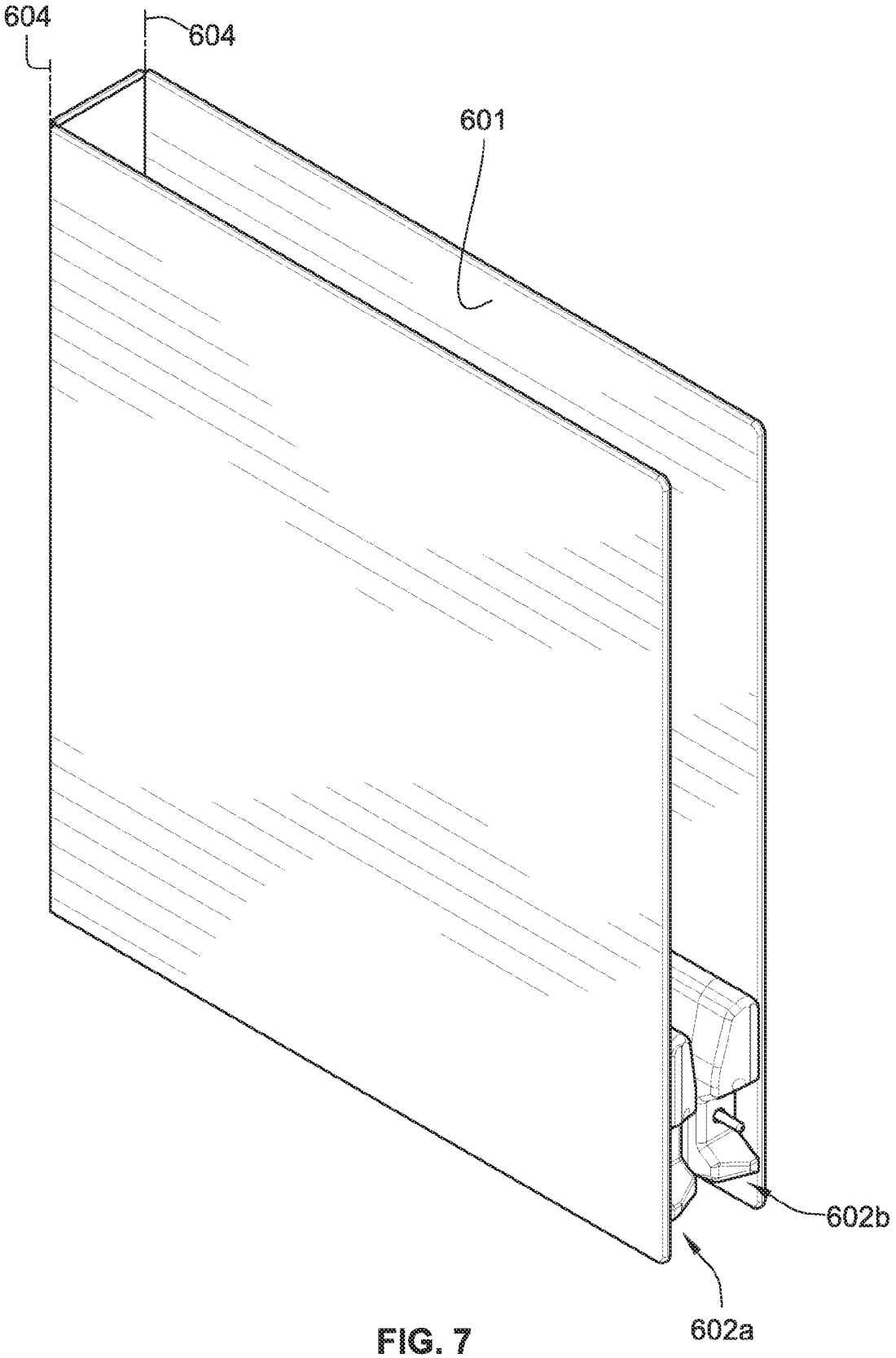
FIG. 7 shows the music portfolio in a folded position.

Furthermore, the portfolio 601 further includes a pair of vertical living hinges 604 that permit the portfolio 601 to be folded generally in half along respective vertical axes for storage and transportation. Referring to FIG. 7, the portfolio 601 is illustrated in a folded position in which (a) the portfolio 601 has been folded along the living hinges 604 and (b) the light bars 602*a*, 602*b* have been folded upwards along the hinges 603.

The light provides complete and substantially uniform illumination of both facing pages of the music score (i.e. the complete planar area to the portfolio) while minimizing any light that washes beyond the music score over the sides and the top of the portfolio.

Figure 8:
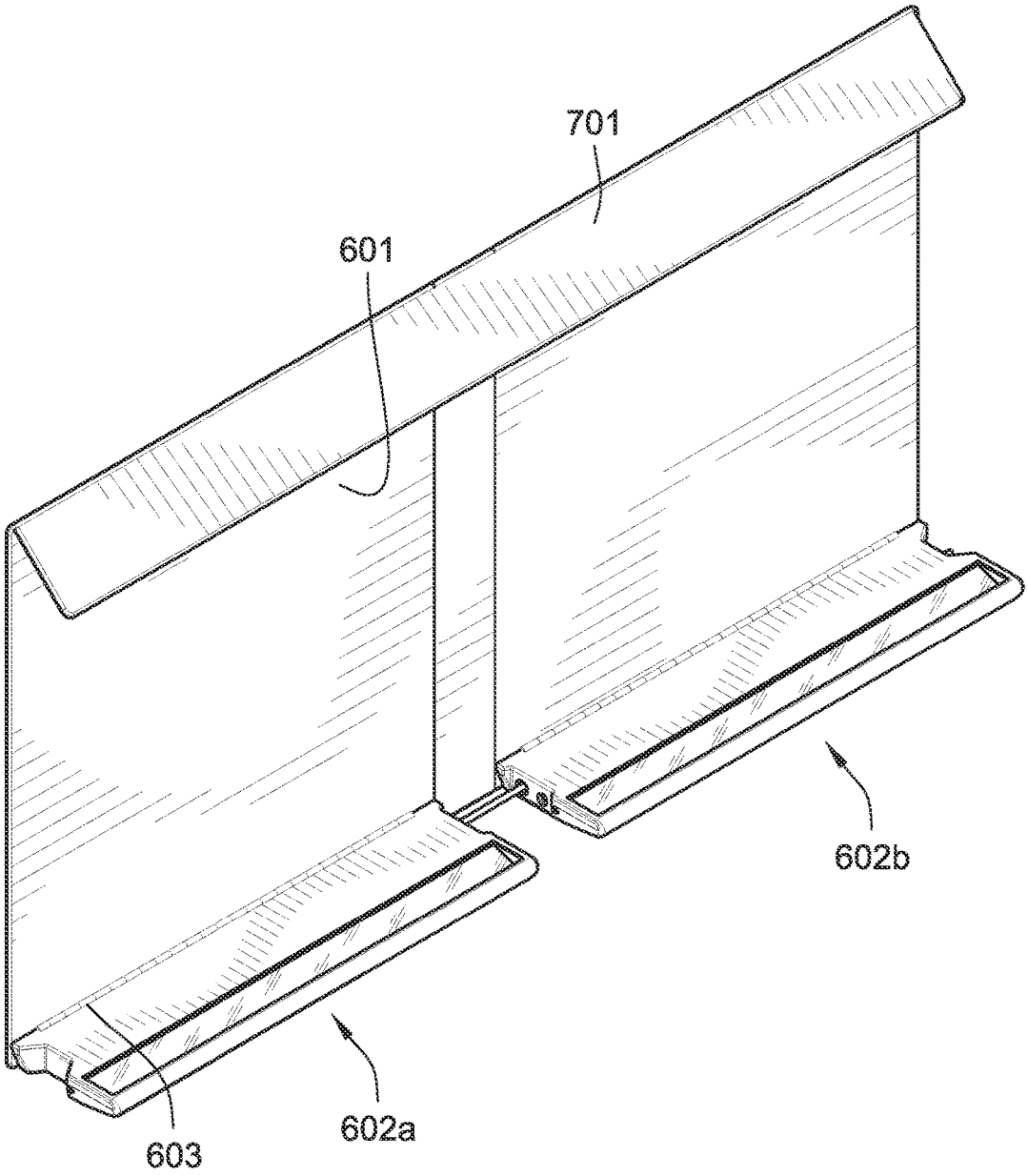
FIG. 8 shows a top reflector option for the music portfolio.

As per FIG. 8, optionally, a flip-up shield 701 (or top reflector) can be added at the top to absorb spillage. This can be useful, for example, if the portfolio 601 supports variable sizes. Optionally, the flip-up shield 701 includes a mirror on an internal, light-receiving surface for improving the performance of the flip-up shield 701

Different configuration of the portfolio 601 can be created by integrating light bars of similar or different dimensions and characteristics can be integrated on each side of the portfolio and/or on the top and/or bottom of the portfolio.

Alternatively the portfolio could comprise three or more planar surfaces, each of which having a light bar at the bottom and/or top.

The characteristics of the light bars are designed to achieve a uniform light across the surface. For example, the side light bars may consist of a lower number of rows of LEDs, where each row consists of a larger number of LEDs.

The light bar can be mounted on a sliding mechanism to allow it to be extended out further (to account for thicker books).

One or more light bars can be integrated into any planar surface that requires lighting. For example, it can be integrated into a picture or artwork frame, either at the bottom, top or sides or any combination thereof.

One or more light bars can be integrated into a book holder to be used as a portable book light.

One or more light bars can be integrated at the base of a tripod or pedestal for presentations or to display menus.

Figure 9:
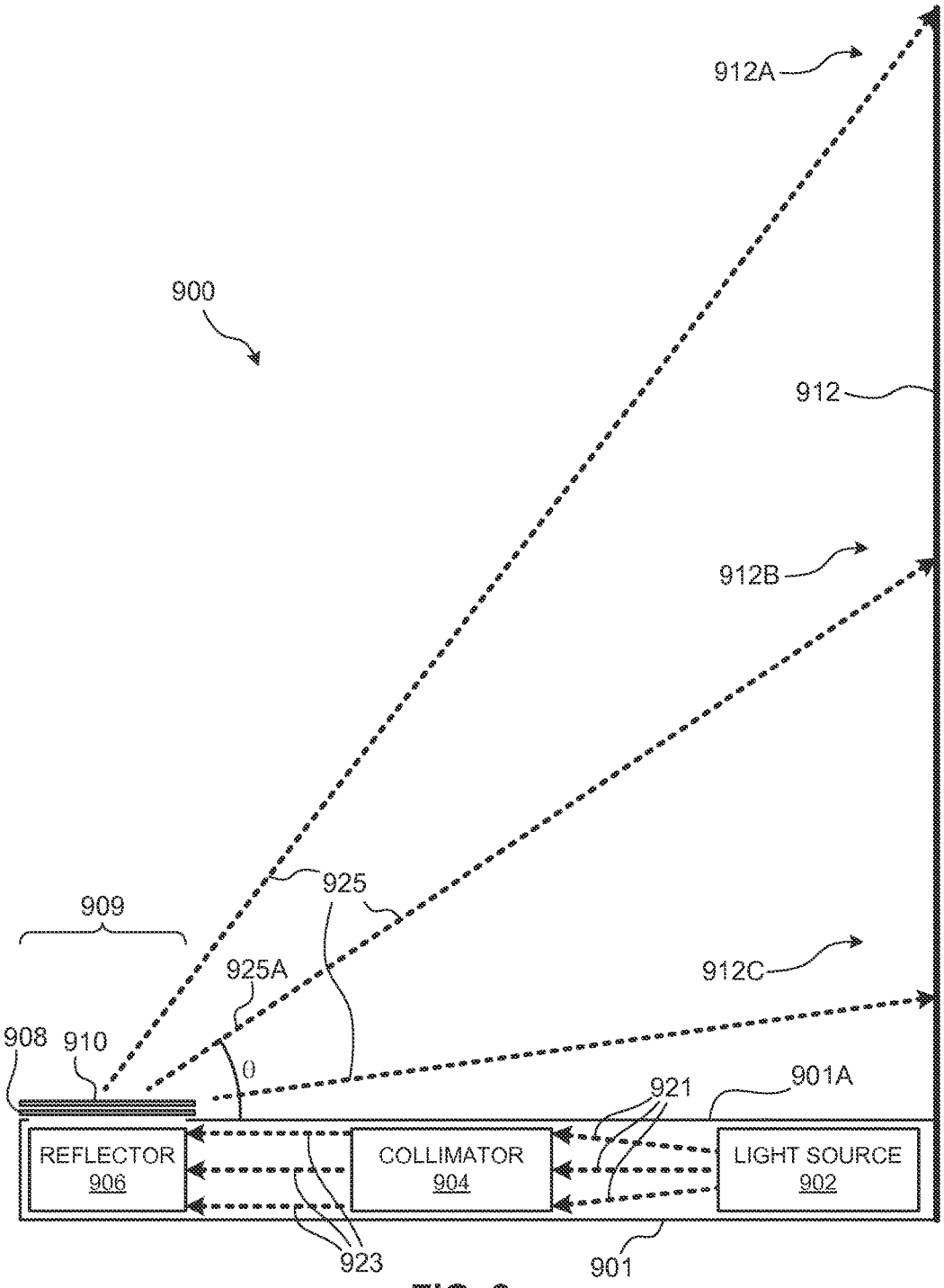
FIG. 9 shows a functional block—side view diagram of a further exemplary embodiment of a lighting system.

With reference to FIG. 9, a further exemplary embodiment of a lighting system indicated generally by the numeral 900 will now be discussed.

The lighting system 900 comprises a light bar housing 901 which houses a light source 902, a collimator 904, and a reflector 906. Above the reflector 906 is a transparent portion 909 of a top wall 901A of the light bar housing 901 which permits light reflected from the reflector 906 to exit the light bar housing 901. The transparent portion 909 of the top wall 901A comprises a light diffuser 908 and a privacy shield 910. Finally, the lighting system 900 comprises a substantially vertical planar surface 912 against which a target document for illumination rests. For the purposes of discussion, portions of the substantially vertical planar surface 912 which are the closest to the light bar housing 901 shall be referred to as proximate portions 912C, portions of the substantially vertical planar surface 912 which are farthest from the light bar housing 901 shall be referred to as distal portions 912A, while portions of the substantially vertical planar surface 912 which lie between the distal portions 912A and the proximate portions 912C shall be referred to as middle portions 912B.

Similar to that of other embodiments described hereinabove, the light source 902 generally extends along a longitudinal axis of the light bar housing 901, and as such is an extended light source. Equally, the collimators, reflectors, diffusers, and privacy shields of this and other embodiments are elongate and extended, extending along a longitudinal axis of the light bar housing 901. The light source 902 may comprise a number of LEDs as the embodiments described hereinabove, while in other embodiments the light source 902 is comprised of any combination of incandescent light sources, fluorescent light sources, LED sources, OLED sources, AMOLED sources, quantum dot sources, laser sources and light sources of any other type which are arranged together so as to direct light primarily in a direction towards the collimator 904. As with the embodiments described hereinabove, the combination of light sources are chosen so as to produce a desired spectral distribution, i.e. color or lack thereof for desired illumination of the target document. The size, shape, and nature of the collimator 904 will of course depend upon the intensity distribution and direction of original light 921 propagating from the light source 902 which of course depends upon the nature and composition of the light source 902. It is contemplated that the lighting system 900 may be arranged to accommodate any desired type of light source which exists or may be developed.

With respect to function, the light source 902 of the lighting system 900 emits the original light 921 which typically radiates away from the light source 902 in multiple divergent directions. This original light 921 enters the collimator 904 which serves to redirect the original light 921 into parallel rays. The collimator 904 also serves to focus the original light 921 in a manner which takes into account intensity as well as directionality. The collimated light 923, therefore, which emerges from the collimator 904 is, in exemplary embodiments, substantially parallel, unidirectional, and homogeneous in intensity. The nature of the collimator 904, its shape, material, its component parts and their arrangement, will depend upon the form of the original light 921 it receives from the light source 902. The greater the quality, less complicated the directionality, and the smoother the distribution of intensity of the original light 921, the less complicated the structure of the collimator 904 must be in order to produce substantially parallel, unidirectional, and homogeneous collimated light 923. In general the collimator 904 may be comprised of directional light films, lenses, reflectors, blinds, fibers, or any other optical components which are combinable to collimate the particular distribution of the original light 921.

In some applications, the collimated light 923 is less than ideal, deviating from being substantially parallel, from being unidirectional, or from being homogeneous in intensity, or any combination thereof. Such applications (as described hereinbelow) generally require the use of a diffuser 908.

The reflector 906 receives the collimated light 923 and reflects it towards the substantially vertical planar surface 912 through the transparent portion 909 of the top wall 901A. As described hereinbelow, although each of the light diffuser 908 and the privacy shield 910 change (to some degree) the nature and direction of light emerging from the reflector 906, it is the reflector 906 which determines primarily the intensity distribution and directionality of the resultant light 925 propagating from the transparent portion 909 to the substantially vertical planar surface 912. The reflector 906 reflects the collimated light 923 such that the intensity of light emerging from the transparent portion 909 and destined for the distal portions 912A of the substantially vertical planar surface 912 is greater than an intensity of light emerging from the transparent portion 909 and destined for the middle portions 912B, which is itself greater than an intensity of light emerging from the transparent portion 909 and destined for the proximate portions 912C of the substantially vertical planar surface 912. This variation in the intensity of light emerging from the transparent portion 909 is such that the effects of the distance between the transparent portion 909 and portions of the surface of the substantially vertical planar surface 912, and effects caused by the angle at which the resultant light 925 is incident upon portions of the substantially vertical planar surface 912 are compensated for so as to create a substantially uniform illumination of the substantially vertical planar surface 912 and any substantially vertical planar target document resting against it. As described hereinbelow, portions of the reflector 906 reflect portions of the collimated light 923 at various angles relative to an axis perpendicular to the substantially vertical planar surface 912 or equivalently at angles relative to the top surface 901A of the light bar housing 901. In FIG. 9, resultant light 925 destined for the middle portions 912B of the substantially vertical planar surface 912 propagate at an angle θ relative to the top surface 901A of the light bar housing 901.

Reflected light emerging from the reflector 906 first passes through the diffuser 908. The diffuser 908 serves to diffuse the reflected light, i.e. change its direction of propagation in a random fashion over a small angle. The diffuser creates, for any portion of parallel incident light, a distribution of light diverging over a small angle which may be generally homogeneous in intensity or have an intensity distribution which falls off with the deflection angle, an example of which would be an normal distribution of intensity as a function of angular deflection. The purpose of the diffuser is to compensate for imperfections in the reflector 906, the collimator 904, and the light source 902 by smoothing out potential hotspots or dark spots which would otherwise be present on the substantially vertical planar surface 912 due to those imperfections. As such the total amount of diffusion or the angle of scattering should in general be very small so as to retain the general intensity distribution provided by the reflector 906 which is necessary for uniform illumination of the target document. The amount of diffusion should be chosen to compensate for actual manufacturing limitations in connection with the reflector 906, the collimator 904, and the light source 902. Ideally, as these components perform closer to their ideal (as described below) the amount of diffusion the diffuser 908 must provide may be reduced, and if the light source 902, collimator 904, and reflector 906 are performing within desired tolerances so as to provide a substantially uniform illumination of the substantially vertical planar target document without the diffuser 908, the diffuser 908 may in fact be dispensed with altogether. Such removal of the diffuser 908, if the light source 902, collimator 904, and reflector 906, are of sufficient quality, helps to increase the overall intensity of illumination on the substantially vertical planar surface 912 and hence increases the performance or power-illumination efficiency of the lighting system 900 as a whole.

According to some specific implementations of the lighting system 900, the diffuser 908 is a 10° light diffuser.

Reflected light which has or has not passed through a diffuser 908 may have portions which are propagating in directions which are not within planes perpendicular to a longitudinal axis of the light bar housing 901. The privacy shield 910 serves to attenuate (to varying degrees) or otherwise prevent transmission of this "stray light" which is propagating in directions which are not within planes perpendicular to the longitudinal axis of the light bar housing 901 and to allow light substantially unattenuated to propagate in directions which are within planes perpendicular to the longitudinal axis of the light bar housing 901. Light propagating in directions which are not within said planes perpendicular to the longitudinal axis of the light bar housing 901 may occur due to various imperfections in the light source 902, collimator 904, and reflector 906 as well as effects caused by the diffuser 908. In an ideal environment (described below) the angular variance of light outside of directions within planes perpendicular to the longitudinal axis of the light bar housing 901 is low enough so as not to affect a great amount of resultant light 925 being directed outside of the area of the substantially vertical planar surface 912 where the target document is situated. By way of illustration, such an ideal environment would exist if the light source 902 and the collimator 904 are such that the collimated light 923 is substantially homogeneous and parallel and propagates in a direction within a plane perpendicular to the longitudinal axis of the light bar housing 901, and if the reflector 906 reflects the light so that it remains within planes perpendicular to the longitudinal axis of the light bar housing 901. In such an environment, the privacy shield 910 may be dispensed with for similar reasons that the diffuser 908 may be dispensed with, i.e. if the desired absence of "stray light" may be obtained without the privacy shield 910 the lighting efficiency of the lighting system 900 as a whole may be improved by dispensing with the privacy shield 910 altogether.

According to some specific implementations of the lighting system 900, the privacy shield 910 is an Advanced Light Control Film (ALCF) manufactured by 3M™.

Figure 10:
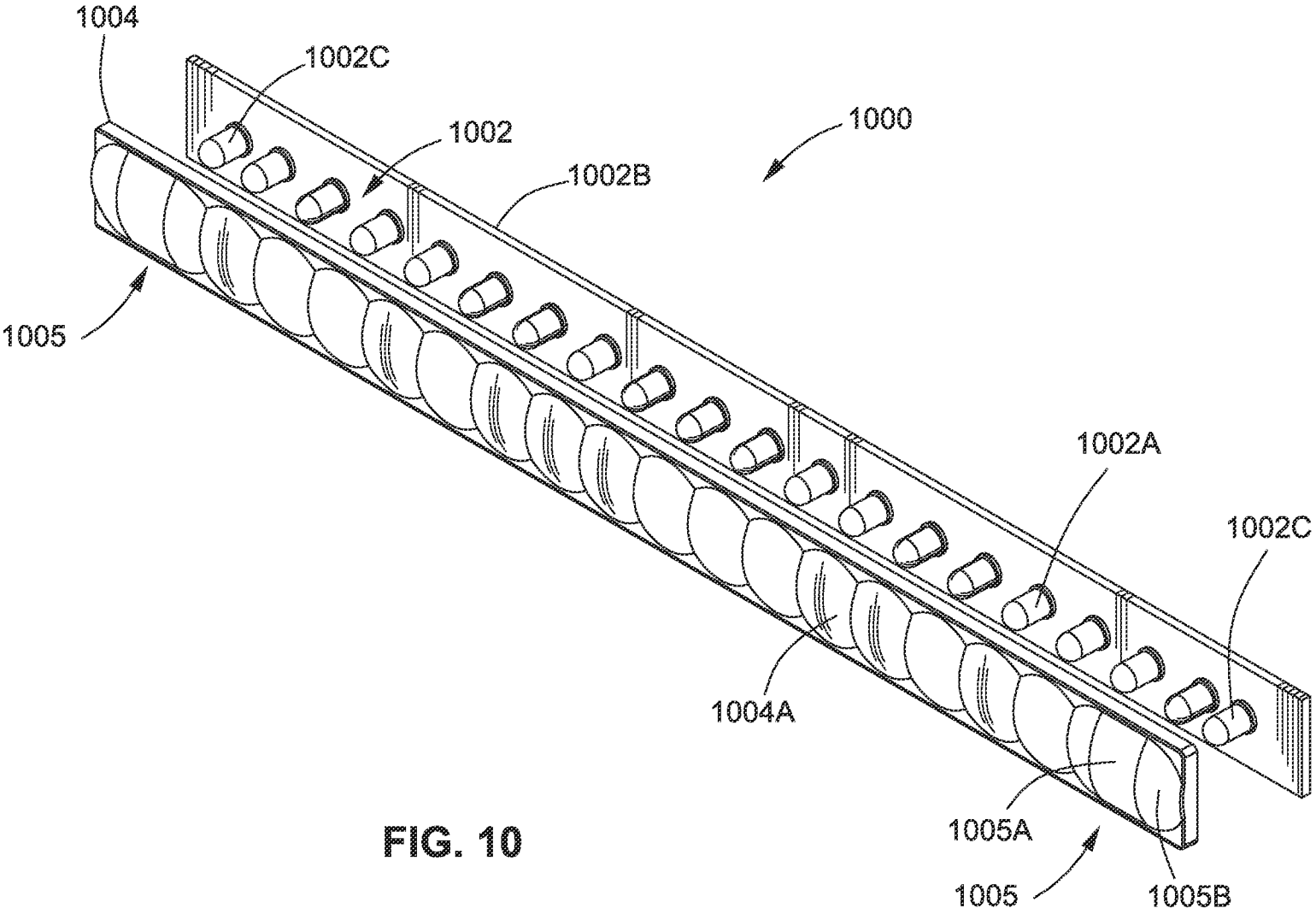
FIG. 10 shows a three quarter view of a particular light source—collimator combination of an embodiment of a lighting system.

Referring now to FIG. 10, a particular arrangement of a light source 1002 and a collimator 1004 of a particular embodiment of a lighting system indicated generally by the numeral 1000 will now be described.

As with the embodiments described hereinabove, the light source 1002, comprises a row of LEDs 1002A spaced evenly apart. These LEDs 1002A are directed towards the collimator 1004 and are mounted in a similar fashion to the embodiments described hereinabove, i.e. on a board 1002B. In addition to the row of evenly spaced apart LEDs 1002A are two end LEDs 1002C which are spaced closer to the end LEDs 1002A of the row than the spacing between the LEDs 1002A within the row.

The collimator 1004 of the embodiment depicted in FIG. 10 consists of a plurality of lenses 1004A each of which is a section of a sphere. The lenses 1004A are spaced such that each lens 1004A substantially intersects its neighboring lenses. The center of each lens in the plurality of lenses 1004A are spaced apart by a distance equal to the spacing between the LEDs 1002A. Moreover, the center of the each lens 1004A is arranged to be directly in front of and centered on a corresponding LED 1002A within the row of LEDs. In the embodiment depicted in FIG. 10, a line passing through the center of a lens 1004A and its corresponding LED 1002A is substantially perpendicular to the substantially vertical planar surface (not shown for clarity). In addition to the row of evenly spaced and intersecting lenses 1004A, are two end compound lenses 1005. Each end compound lens 1005 consists of two spherical sections 1005B smoothly joined by a cylindrical section 1005A. The cylindrical section 1005A has an axis aligned substantially parallel to the longitudinal axis of the light bar housing and has a radius substantially equal to the radius of the spherical sections 1005B. The collimator 1004 of FIG. 10 is substantially flat across a planar surface facing the light source 1002.

Each of the lenses 1004A of the collimator 1004 are shaped and arranged to collimate the light emerging from its corresponding LED 1002A. The presence of the end LEDs and the end compound lenses 1005 are to compensate for end effects created within the light bar housing, providing illumination to an edge of the target document which retains uniformity with an illumination across the entire target document and which falls off rapidly to avoid leakage of light beyond the edge of the target document.

In some specific applications, the entire collimator 1004 comprises a single integral injection molded acrylic lens system.

Figure 11:
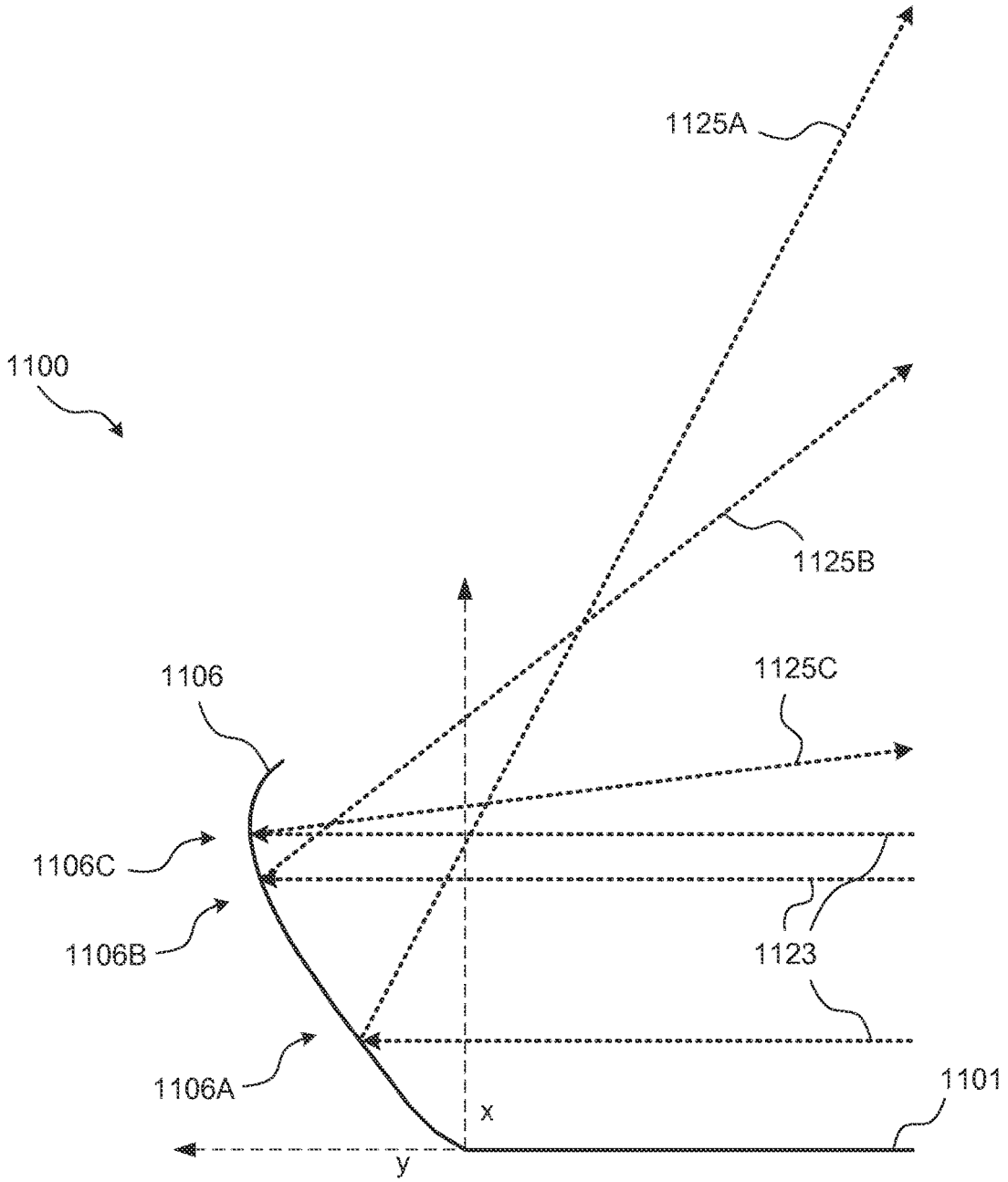
FIG. 11 illustrates a side view of an exemplary reflector of an embodiment of a lighting system.

With reference to FIG. 11 an exemplary reflector of an embodiment of a lighting system generally indicated by the numeral 1100 will now be discussed.

For clarity, only a portion of a base of the light bar housing 1101 and the exemplary reflector 1106 are shown. In the embodiment depicted in FIG. 11, the collimated light 1123 incident upon the reflector 1106 comprises light propagating substantially in a single direction perpendicular to a longitudinal axis of the light bar housing and having a homogeneous intensity. Achievement of the uniform illumination of the target document on the substantially vertical planar surface is achieved primarily by the specific shape of the reflector 1106. As described in association with the embodiment depicted in FIG. 9, reflected light destined for the distal portions of the substantially vertical planar surface, or distal light 1125A emerges from the reflector 1106 having a greater intensity than the intensity of reflected light destined for the middle portions of the substantially vertical planar surface, or middle light 1125B as it emerges from the reflector. This intensity in turn is greater than the intensity of reflected light destined for the proximate portions of the substantially vertical planar surface, or proximate light 1125C as it emerges from the reflector 1106. The differences in intensity of the reflected light as it emerges from the reflector 1106 are such that they compensate for the differences in distance that each of the distal, middle, and proximate light 1125A, 1125B, 1125C must travel before impinging upon the target document on the substantially vertical planar surface, and also compensate for the differences in angle at which each of the distal, middle, and proximate light 1125A, 1125B, 1125C are incident upon the target document.

Given that the intensity of collimated light 1123 is substantially homogeneous, the reflector 1106 comprises various portions having characteristics such that the various intensities are achieved. For clarity, each portion of the reflector 1106 shall be characterized by the destination of the light each reflect, hence, a distal reflection portion 1106A reflects the distal light 1125A which is destined for the distal portions of the substantially vertical planar surface, a middle reflection portion 1106B reflects the middle light 1125B destined for the middle portions of the substantially vertical planar surface, and a proximate reflection portion 1106C reflects the proximate light 1125C destined for the proximate portions of the substantially vertical planar surface. As described hereinabove, as they each emerge from the reflector 1106, the distal light 1125A has a greater intensity than the middle light 1125B which has a greater intensity than the proximate light 1125C. As such, the distal reflection portion 1106A reflects a higher intensity of light per unit area of incident collimated light 1123 than the middle reflection portion 1106B, and the middle reflection portion 1106B reflects a higher intensity of light per unit area of incident collimated light 1123 than the proximate reflection portion 1106C. This is achieved by a continuous variation of the slope of the reflector 1106.

The slope of the reflector 1106 at the distal reflection portion 1106A is angled so that light is reflected to the distal portions of the substantially vertical planar surface and the rate of change of that slope along the reflector 1106 at the distal reflection portion 1106A is relatively low i.e. the amount of curvature is relatively shallow. This means that the change in angle θ of the distal light 1125A with respect to a variation along the curve of the reflector 1106 is relatively low. This in turn means that portions of collimated light 1123 reflected from the distal reflection portion 1106A "sweep" through a relatively small angle dθ with respect to a variation dx along the curve of the reflector 1106. This leads to a relatively high intensity of light emerging from the reflector 1106 at the distal reflection portion 1106A.

The slope of the reflector 1106 at the middle reflection portion 1106B is angled so that light is reflected to the middle portions of the substantially vertical planar surface and the rate of change of that slope along the reflector 1106 at the middle reflection portion 1106B is relatively moderate i.e. the amount of curvature is relatively moderate. This means that the change in angle θ of the middle light 1125B with respect to a variation along the curve of the reflector 1106 is moderate. This in turn means that portions of collimated light 1123 reflected from the middle reflection portion 1106B "sweep" through a relatively moderate angle dθ with respect to a variation dx along the curve of the reflector 1106. This leads to a relatively moderate intensity of light emerging from the reflector 1006 at the middle reflection portion 1106B.

The slope of the reflector 1106 at the proximate reflection portion 1106C is angled so that light is reflected to the proximate portions of the substantially vertical planar surface and the rate of change of that slope along the reflector 1106 at the proximate reflection portion 1106C is relatively high i.e. the amount of curvature is relatively sharp. This means that the change in angle θ of the proximate light 1125C with respect to a variation along the curve of the reflector 1106 is relatively high. This in turn means that portions of collimated light 1123 reflected from the proximate reflection portion 1106C "sweep" through a relatively large angle dθ with respect to a variation dx along the curve of the reflector 1106. This leads to a relatively low intensity of light emerging from the reflector 1106 at the proximate reflection portion 1106C.

The relative intensities of the distal light 1125A, middle light 1125B, and proximate light 1125C is such that the relative distances and angles of incidence upon the substantially vertical planar surface are compensated for, and a relatively uniform illumination of the substantially vertical planar surface is achieved.

Although the substantially vertical planar surface, the resultant and the reflected light, as well as the reflector itself have been described in terms of three portions, it is to be understood that the number of portions described and the mere fact of division of each into a discrete number of portions was only for illustrative purposes. Each of the substantially vertical planar surface, the resultant and the reflected light, as well as reflector itself comprises a continuum of a virtually infinite number of portions. Specifically, in regard to the reflector 1106, in the embodiment depicted in FIG. 11, the slope and the change in slope (second derivative) continuously and smoothly changes along the curve of the reflector 1106, there being no actual functional change or discontinuity in the slope or the second derivative of the curve dividing the curve into the three portions described above. For some embodiments, the limits of manufacturing and acceptability of tolerances in operation will result in reflectors 1106 which may have discontinuities in slope, such as would be the case for a reflector having a curve approximated by a series of flat segments, the operational tolerances determining the number of required segments and the amount of discontinuity allowed.

In general, the value of the second derivative of a point on the reflector varies as a monotonic increasing function with a distance at which light reflected from that point falls along the substantially vertical planar surface, that distance measure from the light bar housing. Equally, the radius of curvature varies from a relatively large value (shallow curve) at portions which reflect light towards the distal portions of the substantially vertical planar surface to a relatively small value (sharp curve) at portions which reflect light towards the proximate portions of the substantially vertical planar surface.

It has been found that in conjunction with the collimator 1005 and light source 1002 of FIG. 10, the particular curvature of the reflector 1106 as depicted in FIG. 11 functions well to produce uniform illumination of a target document on the substantially vertical planar surface. With reference to the axes depicted in FIG. 11, the shape of the curve may be described in terms of a 5-degree polynomial best fit trendline having the following equation: $y=-3.35421E-13x^5-3.29909E-09x^4+2.79710E-06x^3-1.18229E-03x^2+9.55410E-01x$.

In some specific embodiments, the reflector 1106 is a reflective mirrored mylar sheet.

Although specific embodiments comprise a closed housing, a source producing ideal collimated light (with little to no stray light) and the exemplary reflector (with insignificant imperfections) in a fixed arrangement with respect to the substantially vertical planar surface will suffice to produce the benefits of uniform illumination of that planar surface and minimization of stray light.

Although the embodiments described hereinabove are in the context of illuminating a document or small flat paper object such as sheet music or a book, embodiments such as those described in association with FIGS. 9, 10, and 11, may be implemented in any application which would benefit from uniform illumination of a substantially planar target. Such applications include the lighting of passive eReaders, the lighting of billboards, the lighting of buildings and/or walls (both interior and exterior), the lighting of keyboards (both musical and computer) and any other substantially planar instrumentation or control panel. In general it is contemplated that embodiments of the lighting system may be used in any application which benefits from uniform illumination on a substantially planar target and the reduction of stray light projected away from the target.

While particular embodiments and applications of the present invention have been illustrated and described, it is to be understood that the invention is not limited to the precise constructions and compositions disclosed herein and that various modifications, changes, and variations may be apparent from the foregoing descriptions without departing from the spirit and scope of the invention as defined in the appended claims.

The invention claimed is:

1. A lighting system for illuminating a substantially planar target with substantially uniform illumination, the lighting system comprising:

an elongate reflector extending in a direction parallel to the substantially planar target and spaced apart from an edge of the substantially planar target in a direction perpendicular to the substantially planar target; and an elongate collimated light source extending in a direction substantially parallel to the direction in which the elongate reflector extends, and situated between the elongate reflector and the edge of the substantially planar target, the elongate collimated light source oriented so as to project collimated light towards the elongate reflector;

the elongate reflector having a reflective concave curved surface facing the substantially planar target such that collimated light from the elongate collimated light source is reflected by the elongate reflector to form reflected light, wherein for each point along a substantially vertical surface of the substantially planar target to which portions of the reflected light are reflected there are corresponding locations along the reflective concave curved surface from which the portions of the reflected light are reflected, and wherein the radii of curvature at locations along the reflective concave curved surface vary as a monotonic increasing function with a distance measured from the edge of the substantially planar target to the points along the substantially planar surface to which the locations correspond;

wherein the intensity of the reflected light reflected from said locations along the reflective concave curved surface have an intensity which varies as a monotonic increasing function with the radii of curvature at said locations;

wherein the elongate collimated light source comprises:

an elongate light source extending in a direction substantially parallel to the direction in which the elongate reflector extends, and situated between the elongate reflector and the edge of the substantially planar target, the elongate light source oriented so as to project uncollimated light towards the elongate reflector; and an elongate collimator extending in a direction substantially parallel to the direction in which the elongate reflector extends, and situated between the elongate reflector and the elongate light source, the elongate collimator oriented so as to collimate the uncollimated light from the light source to form the collimated light.

2. A lighting system according to claim 1 wherein the radii of curvature of said reflective concave curved surface varies continuously along the reflective concave curved surface.

3. A lighting system according to claim 1 further comprising an elongate diffuser extending in a direction substantially parallel to the elongate reflector and situated between the elongate reflector and the substantially planar target, the diffuser oriented to diffuse the reflected light to compensate for irregularities in at least one of the collimated light and the elongate reflector.

4. A lighting system according to claim 1 further comprising an elongate privacy shield extending in a direction substantially parallel to the elongate reflector and situated between the elongate reflector and the substantially planar target, the privacy shield oriented to compensate for irregularities in at least one of the collimated light and the elongate reflector by attenuating reflected light propagating in directions having a component parallel to the direction in which the elongate reflector extends.

5. A lighting system according to claim 4 further comprising an elongate diffuser extending in a direction substantially parallel to the elongate reflector and situated between the elongate reflector and the substantially planar target, the diffuser oriented to diffuse the reflected light to compensate for irregularities in at least one of the collimated light and the elongate reflector.

6. A lighting system according to claim 1 wherein the elongate light source comprises a plurality of LEDs oriented to project the uncollimated light towards the elongate collimator, and wherein the elongate collimator comprises a plurality of intersecting lenses, each intersecting lens being a spherical section and positioned directly in front of a corresponding LED of the elongate light source and oriented to collimate the portion of the uncollimated light projected from the corresponding LED to form a collimated portion of light, the plurality of the intersecting lenses together forming the collimated light from the respective collimated portions of light.

7. A lighting system according to claim 6 further comprising an elongate privacy shield extending in a direction substantially parallel to the elongate reflector and situated between the elongate reflector and the substantially planar target, the privacy shield oriented to compensate for irregularities in at least one of the collimated light and the elongate reflector by attenuating reflected light propagating in directions having a component parallel to the direction in which the elongate reflector extends.

8. A lighting system according to claim 7 further comprising an elongate diffuser extending in a direction substantially parallel to the elongate reflector and situated between the elongate reflector and the substantially planar target, the diffuser oriented to diffuse the reflected light to compensate for irregularities in at least one of the collimated light and the elongate reflector.

9. A lighting system according to claim 8 further comprising an elongate housing extending in a direction substantially parallel to the elongate reflector and arranged to house the elongate reflector, the elongate collimated light source, the elongate diffuser, and the elongate privacy shield and to maintain a fixed relative orientation and position therebetween.

* * * * *